United States Patent [19]

Swenson

[11] 4,161,807

[45] Jul. 24, 1979

[54] APPARATUS AND METHOD FOR LOCKING LOAD SUPPORTING STRUCTURES TOGETHER

[75] Inventor: William J. Swenson, Houston, Tex.

[73] Assignee: Raymond International, Inc., Houston, Tex.

[21] Appl. No.: 837,623

[22] Filed: Sep. 28, 1977

[51] Int. Cl.[2] ..... A44B 21/00

[52] U.S. Cl. ..... 24/263 SW; 24/263 DA

[58] Field of Search ..... 24/263 R, 263 DA, 263 D, 24/263 SW, 263 DH, 136 R, 136 B; 285/18, 323; 403/15, 31, 267, 268; 175/255

[56] References Cited

U.S. PATENT DOCUMENTS

| | | | |
|---|---|---|---|
| 2,839,164 | 6/1958 | Roussel | 24/263 DA |
| 3,076,245 | 2/1963 | Acker | 24/263 DA |
| 3,321,217 | 5/1967 | Ahlstone | 285/18 |
| 3,754,780 | 8/1973 | Pogonowski | 285/421 |
| 3,847,493 | 11/1974 | Peter et al. | 403/370 |

FOREIGN PATENT DOCUMENTS

| | | | |
|---|---|---|---|
| 1046982 | 12/1958 | Fed. Rep. of Germany | 24/263 DH |

*Primary Examiner*—Kenneth J. Dorner

*Attorney, Agent, or Firm*—Fitzpatrick, Cella, Harper & Scinto

[57] ABSTRACT

Two members are locked together by forcing wedge means between mutually facing and converging surfaces of the members, the wedge means causing gripping means to engage one of the members to lock the members together. A fluid pressure is established between the wedge means and at least one surface of one of the members while forcing the wedge means into wedging position between the members to minimize friction between the wedge means and the elements with which they are in contact during movement. When the wedge means is in position, the fluid is terminated to complete the lock.

23 Claims, 18 Drawing Figures

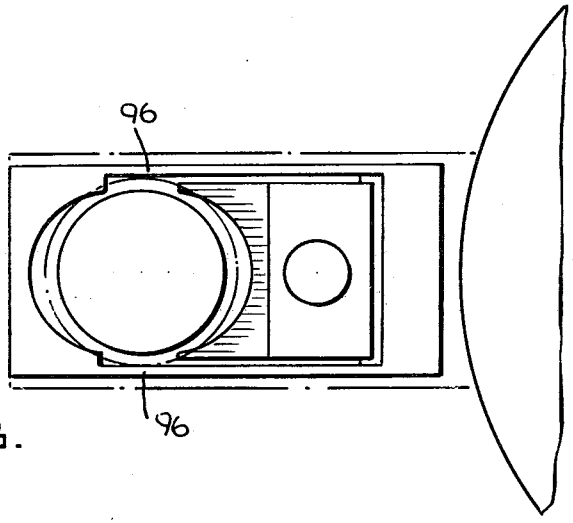
Fig.16.
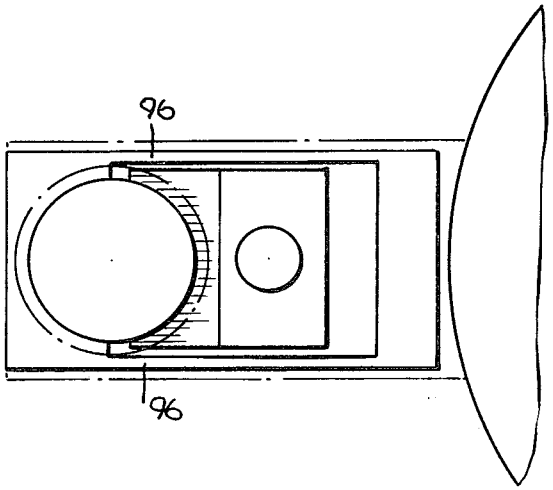
Fig.17.
Fig.15.
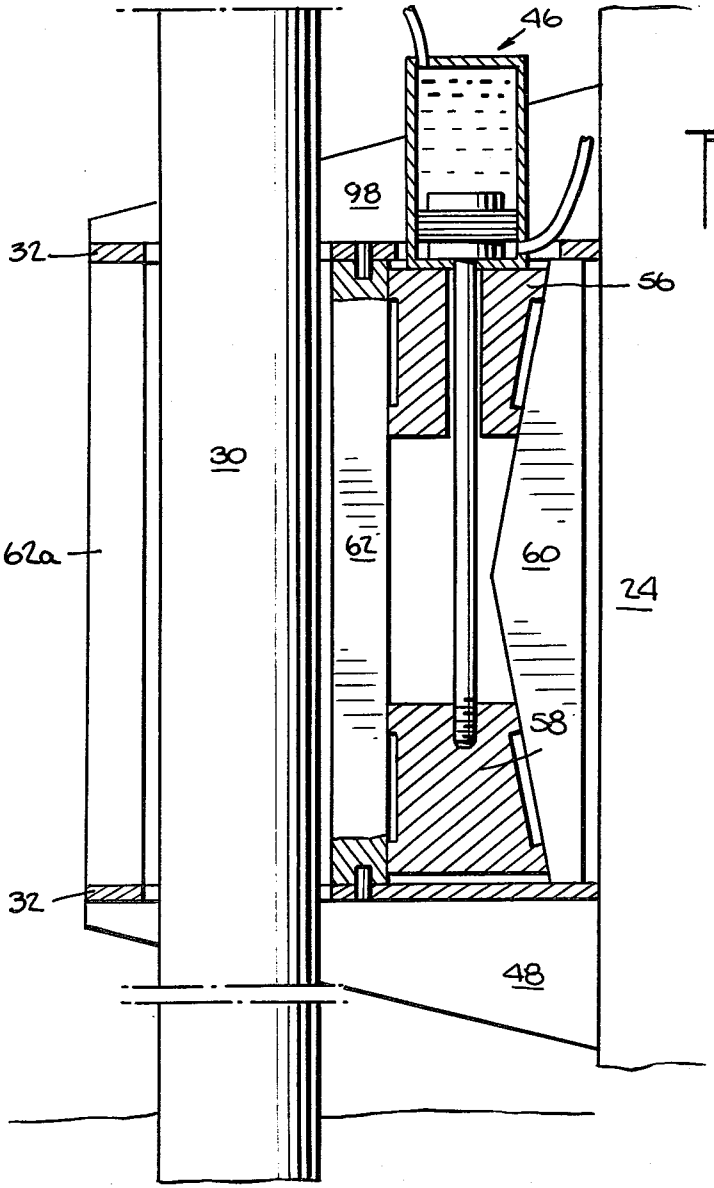

APPARATUS AND METHOD FOR LOCKING LOAD SUPPORTING STRUCTURES TOGETHER

FIELD OF THE INVENTION

This invention relates to apparatus and methods for locking two load supporting structures together, and more particularly, to a system of mechanically connecting a foundation pile to a supporting framework of an offshore drilling platform or a structure of similar nature.

BACKGROUND OF THE INVENTION

DESCRIPTION OF THE PRIOR ART

Offshore platforms of the class described have been anchored to the ocean floor for a number of years, and more recently, it has been found necessary to position such platforms above greater depths of water. Normally, the platform structure is supported by steel pipe pilling driven through pile sleeves that constitute a part of the structure, and for reasonably shallow water depths, it is known to weld the pile to its surrounding sleeve at the working deck level. As water depths increase, the practice is to drive the pile through a sleeve positioned in the lower part of the structure and extending from the mud line, i.e. the sea bed, upward. The annular space between the outer surface of the pile and the inner surface of the sleeve is then filled with a cement grout which hardens to transfer the loading stresses from the sleeve to the pile. Thus, U.S. Pat. No. 3,857,247 discloses an offshore tower which is fastened to a sea bed by means of anchor piles driven down into the sea through tubular sleeves which are fixed to the bottom of the platform. After the anchor piles are driven, their upper ends, which are inside the sleeves, are locked to the sleeves by grout or similar material pumped into the clearance between the piles and the sleeves.

It will be appreciated that this technique is quite costly because, in addition to the substantial length of the sleeves which is necessitated in order to provide a large area for the grout interconnection, steel bars or rods, known as "shear connectors" are frequently welded to adjacent sleeve and pile surfaces to serve as keys for enhancing the locking action of the grout. Moreover, the use of grout for locking anchor piles to sleeves in depths of the order of 500 to 600 feet or more, has been difficult to accomplish in a reliable manner because the grout has to be pumped over a great distance and there is no reliable way of ascertaining whether the grout has fully filled the space between the sleeve and its associated anchor pile. As a result, the sleeve to pile connection is usually made considerably longer than would appear necessary in order to ensure an adequate margin of safety. The apparatus and piping needed to grout the annular space is also subject to mishap or failure, thus necessitating the provision of redundancy equipment. While the cost of these joints is considerable, even with the best of care satisfactory results are not always assured and the time required to pump the grout between the pile and the sleeve, and the time required for the grout to set, give rise to the possibility of disturbance of the grout during these periods, especially if heavy weather should shake the platform.

Various other efforts have been made to position offshore platforms by securing same to piles driven into the ocean floor as in U.S. Pat. No. 3,754,780 for example, which discloses a remote control, retractable locking clamp for detachably telescoping a cylindrical element of an offshore drilling tower with a subsurface structural cylindrical inner pile element. The clamp is fashioned in two parts with tapered overlapping ends positioned between the two cylindrical elements and encircling the pile element and its ends are hook shaped to receive therebetween a tapered pin movable by a reversible motor under remote control from the surface. The overlap is increased as the pin is moved further into the space between the hook shaped clamp end, thus causing the clamp elements to grip the outer sleeve elements detachably to lock the sleeve to the pile. Removing the tapered pin induces contraction of the clamp in order to unlock the sleeve from the pile.

A coupling apparatus useful for releasably securing various well components to one another is disclosed in U.S. Pat. No. 3,321,217 wherein clamping and unclamping is effected by shifting wedge rings under the control of reciprocal pistons, the wedge rings acting upon locking dogs movable radially of the elements to be connected in order to effect clamping.

In U.S. Pat. application Ser. No. 759,028 filed Jan. 13, 1977, there are disclosed arrangements whereby a structure is locked to an elongated anchor member. For example, an anchor member and the structure may be provided with mutually facing surface portions that converge toward each other in a downward direction. Wedges which are shaped to fit inside the space defined by converging surface portions are lowered into the space so as frictionally to engage these surface portions and a bias weight is then lowered onto the wedges to hold them in locking frictional engagement with the converging surfaces. The bias weight maintains the system in locked condition over extended periods of time.

Other teachings of interest are found in U.S. Pat. Nos. 2,989,326 and 3,847,493.

SUMMARY OF THE INVENTION

I have conceived and contribute by the present invention, a method and apparatus according to which I am able to overcome the aforenoted disadvantages of the prior art and to provide a novel anchoring technique utilizing a mechanical joint for rigidly connecting a pile to a pile sleeve while reducing the linear length of engagement between them, and at the same time providing a dependable connection, substantially reducing the tonnage of pile and sleeve materials, and effecting considerable economy.

According to one aspect of the present invention, I contribute a method of locking two members together by the forcing of a wedging element between mutually facing and converging surfaces of said members, the method comprising the steps of establishing a positive fluid pressure substantially in excess of ambient pressure between at least one surface of the wedging element and a facing surface of one of the members while forcing the wedging element into wedging position between the members and then releasing the pressure to effectuate the lock. More specifically, I prefer to establish the positive fluid pressure between the mutually facing and converging surfaces of the members and the respective surfaces of the wedge means facing said surfaces of the members. I may also provide gripping means between one surface of the wedge means and a surface of one of the members in which case the positive fluid pressure is established between one of the converging surfaces and a surface area of the wedge means facing same and between a surface of the gripping means and a surface area of the wedge means facing the gripping means and the force exerted on the wedging means shifts the gripping means into gripping engagement with the member facing it. The force may be applied under sufficient magnitude to cause the gripping means to deform the member against which it is urged in order to provide therein a seat for itself.

According to another aspect of this invention, I contribute apparatus for locking two load supporting members together comprising: a surface on one of the members, i.e. a cam member, converging relative to an opposite surface on the other member, wedge means between the members and having surfaces respectively facing the converging surface and the surface of the other of the members, means adapted to force the wedge means along the converging surface in a converging direction relative to the facing surface of the other of the members, gripping means movable toward the other of the members upon such movement of the wedge means to engage and grip the other of the members, and pressure means for establishing a positive fluid pressure substantially in excess of ambient pressure between the surface of the wedge means and the converging surface while the wedge means slides along the converging surface. A surface of the wedge means and the surface of the one of the members, the cam member, for example, facing the wedge means surface are preferably inclined relative to the surface of the other member at an angle selected so that the friction forces developed therebetween, when the gripping means engage and grip the other member, render the same in self-locking disposition.

One or more of the surfaces that move in frictional contact with facing surfaces may be formed with a recess and I prefer then to establish the positive fluid pressure in the recess. In this way I provide a fluid bearing between the wedge means and the inclined surface and I may also provide a similar fluid bearing between the wedge means and the other of said members or the gripper means where the gripper means is an element separate from the wedge means. The fluid bearing serves materially to reduce, and in fact virtually eliminates friction between respective sliding surfaces. Actually, I prefer that the recess or recesses be formed in the wedge means surrounded by lands formed to present gripping regions so as to minimize leakage of the pressurized fluid.

Each wedge means may be provided with a sleeve disposed to telescope out from the wedging surfaces of the wedge means with its outer end engaging the respective surface facing the wedge means; and I may employ spring means in each recess initially to urge the sleeves towards those respective surfaces. Moreover, I provide seal means between the sleeves and the surfaces defining the recesses and between the ends of the sleeves and the respective surfaces against which they are urged. As will later become apparent, these sleeves serve to reduce leakage of the pressurized fluid from the recesses.

The gripping means may constitute a surface on the wedge means or a separate element may be provided adjacent the wedge means to be driven by movement of the wedge means in a converging direction to engage and grip one of the members. In the latter case, I provide retainer means and means connecting the retainer and gripping means normally to maintain the gripping means in its initial or inactive position. The connecting means may be frangible pins, for example, studded into the retainer and connecting means and adapted to rupture under the influence of the means for moving the wedge means to allow the gripping means to move to the surface of the member to be gripped.

The wedge means may comprise several wedge elements and the means adapted to force the wedge means along the converging or cam surfaces are preferably in the form of a double acting piston and cylinder or ram arrangement, the piston being connected to the wedge elements so that when the piston moves in one direction, the wedge means move to shift the gripping means to lock the supporting members together and when the piston moves in the other direction, unlocking of the supporting members is effected.

In addition to the gripping means already referred to, and which may be considered active gripping means, I may provide second or passive gripping means carried by one of said members to be locked together, the second gripping means facing a surface of the other member so that the second or passive gripping means are drawn towards the other member by the wedge forcing means after the first or active gripping means contacts its facing surface, wherefore both gripping means tightly grip the respective facing surfaces of the member to be gripped.

Where recesses are used to reduce friction, as already explained, the positive fluid pressure is established in the recesses. In this connection, it will be appreciated that when pressurized fluid is established in the recesses, it is interposed between the wedge and its respective facing surface to hold the lands, and the gripping regions presented thereby, away from the facing surfaces. Actually, the pressurized fluid causes some slight deformation of the facing surfaces to occur in a direction away from the wedge means and the wedge means can move easily, requiring only a relatively small force for the purpose. When the parts reach locking position, the pressure on the fluid in the recesses is released whereupon the aforementioned deformation is relieved and the gripping regions formed by the lands around the recesses grip the facing surfaces to lock the parts together.

There has thus been outlined rather broadly the more important features of the invention in order that the detailed description thereof that follows may be better understood and in order that the present contribution to the art may be better appreciated. There are, of course, additional features of the invention that will be described hereinafter and which will form the subject of the claims appended hereto. Those skilled in the art will appreciate that the conception upon which this disclosure is based may readily be utilized as a basis for the designing of other structures for carrying out the several purposes of the invention. It is important, therefore, that the claims be regarded as including such equivalent constructions as do not depart from the spirit and scope of the invention.

BRIEF DESCRIPTION OF THE DRAWINGS

Specific embodiments of the invention have been chosen for purposes of illustration and description, and are shown in the accompanying drawings forming a part of the specification wherein:

FIGS. 15 to 17 are cross-sectional views illustrating another embodiment of the invention.

DESCRIPTION OF THE PREFERRED EMBODIMENTS

Figure 1:
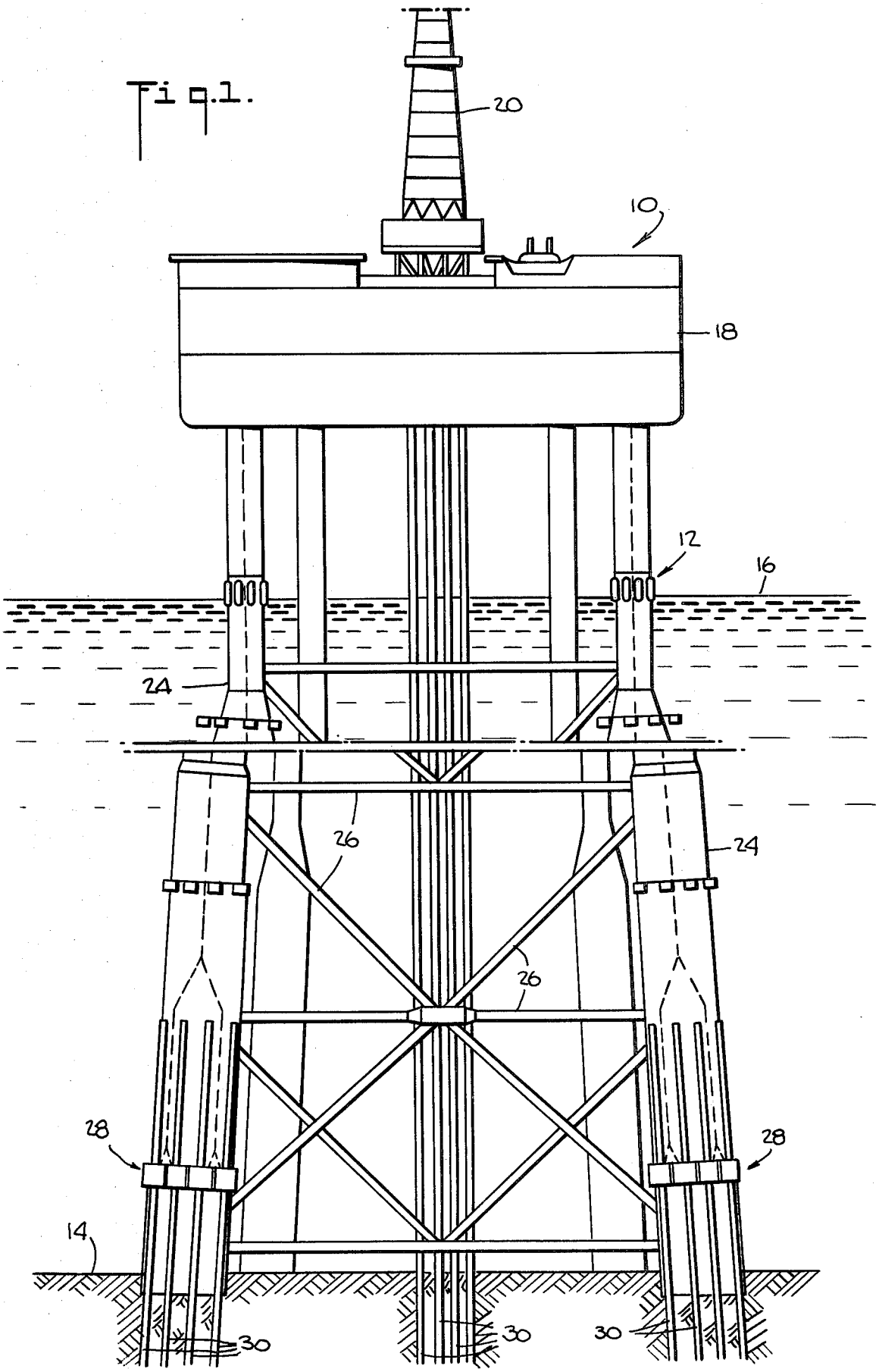
FIG. 1 is an elevational view of an offshore tower anchored in the sea bed and secured by means according to the present invention.

In FIG. 1, there is shown an offshore tower 10, comprising a framework type template 12 which rests on a sea bed 14 and extends up past the sea surface 16 to support a platform 18 up out of the wave and tide action which occurs at the sea surface. The platform 18, in most cases, is used for exploratory drilling and for the pumping of oil up from under the sea bed; and accordingly, a drilling tower 20, derricks and other equipment (not shown) suitable for this purpose may be provided on the platform. The platform 18 may be constructed separately from the template 12 and assembled onto the template after the template has been anchored to the sea bed 14, or the platform and template may be preassembled and set up on location as an integral unit. The present invention however is not concerned with the specific relationship between the template and platform, but rather it is concerned with the methods and apparatus for anchoring the structure in place.

Figure 2:
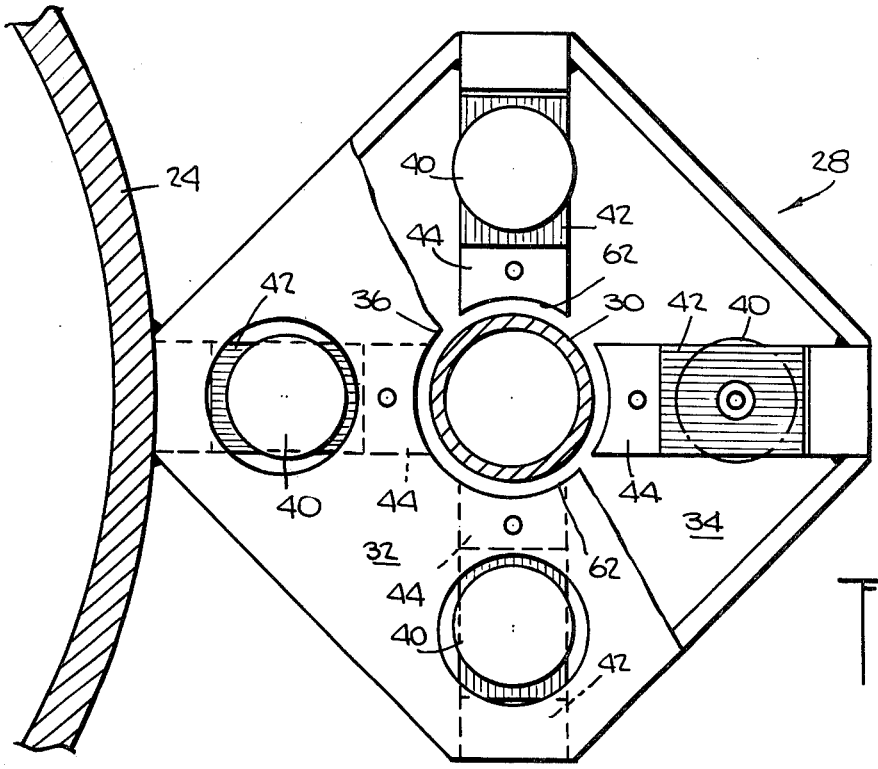
FIGS. 2 and 3 are schematic, horizontal, partial cross-sectional views taken through a collar and pile and illustrating elements of the invention in unlocked and locked positions, respectively.
Figure 3:
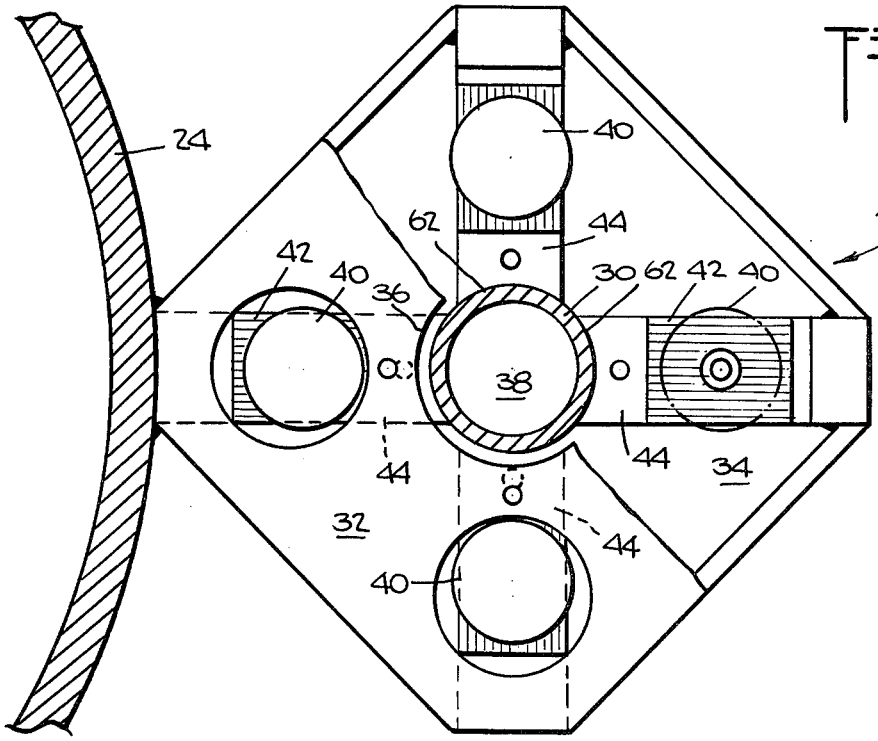

As can be seen in FIG. 1, the template 12 is made up of a plurality of upstanding legs 24 which are held in fixed relationship to each other by elongated framework members 26. The lower end of each of the legs 24 rests on the sea bed 14. As can be seen in FIGS. 1, 2 and 3, a plurality of collars 28 are arranged about the outside of each leg and are affixed to the leg by welding or other means. Elongated anchor piles 30 extend down through the collars 28 and are driven into the sea bed 14. The anchor piles are driven down to a depth at which they become securely anchored against both tensile and compressive loads. Means, to be described hereinafter, are provided to lock the anchor piles 30 to the collars 28 in accordance with the present invention.

An anchor pile 30 is inserted down through the upper end of each collar 28 and is passed through the collar which guides it as it is driven down into the sea bed. The pile 30 is driven by hammer means, which may be of any type well known in the art.

In FIGS. 2 and 3, the collars 28 are shown as diamond-shaped in horizontal cross-section and as having top and bottom retainer plates 32 and 34, respectively, and these are provided with congruent central apertures 36 (only the upper one of which is shown) through which piles 38, illustrated as steel pipe piles, are driven. Each collar is equipped with four rams 40, wedge means 42 and grippers 44 in cruciform disposition relative to the central apertures 36.

Figure 4:
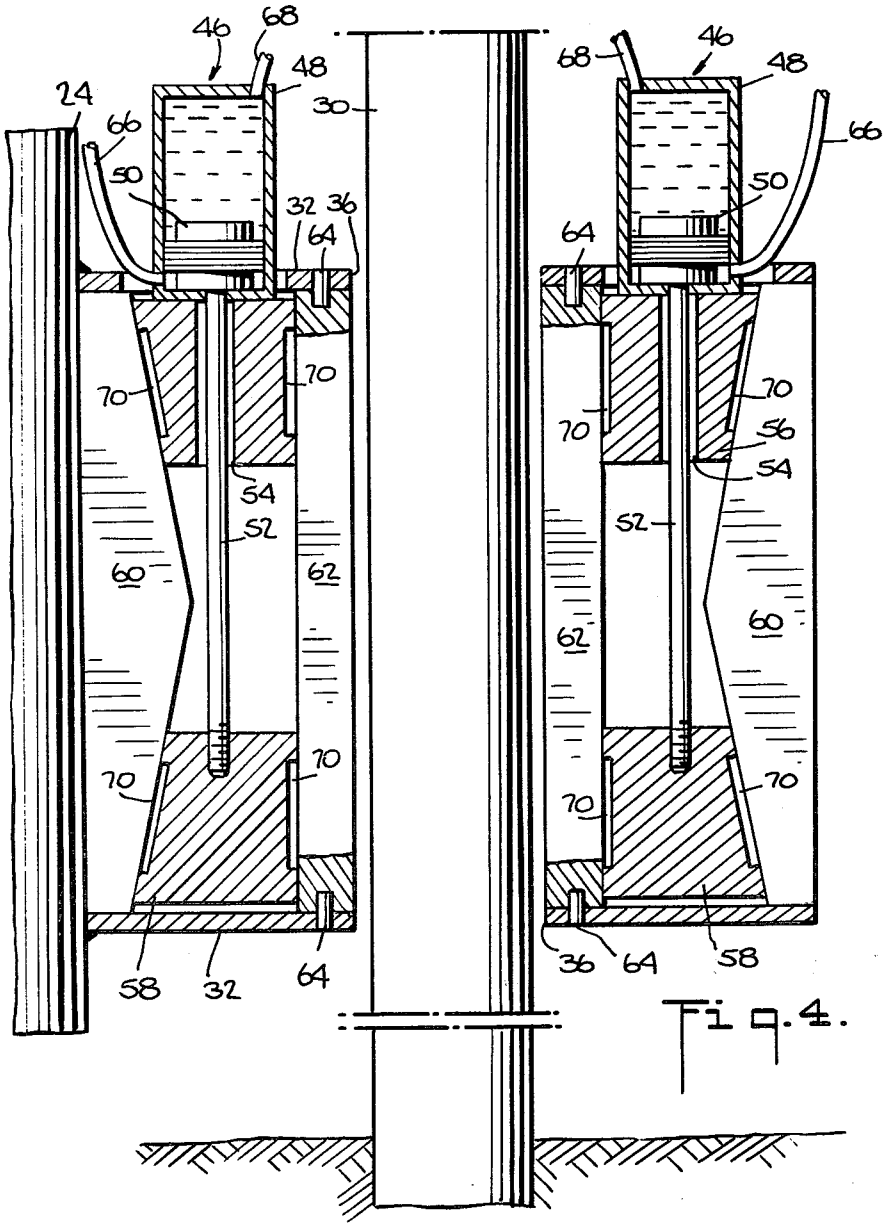

For purposes of a broad description of the structure and function of the device, FIG. 4 illustrates the normal condition of a typical locking assembly wherein the collar retainer plates 32 are welded to a leg 24 and a pile 30 passes through apertures 36. The retainer plates support rams 46, each of which include a cylinder 48, piston 50 and connecting rod 52, the latter passing downwardly through a bore 54 in an upper wedge element 56 for threaded engagement with a lower wedge element 58. One side of each wedge element is inclined for sliding contact with respective converging surfaces of a cam member 60, and the opposite or inner side of each wedge element abuts against a gripper 44 which extends the full distance between the retainer plates 32 and has a surface 62 shaped to engage the surface of the pile 30 (FIGS. 2 and 3), and may be scored or serrated for firm gripping. Frangible pins 64 are studded in each retainer plate and the ends of each gripper.

Figure 5:
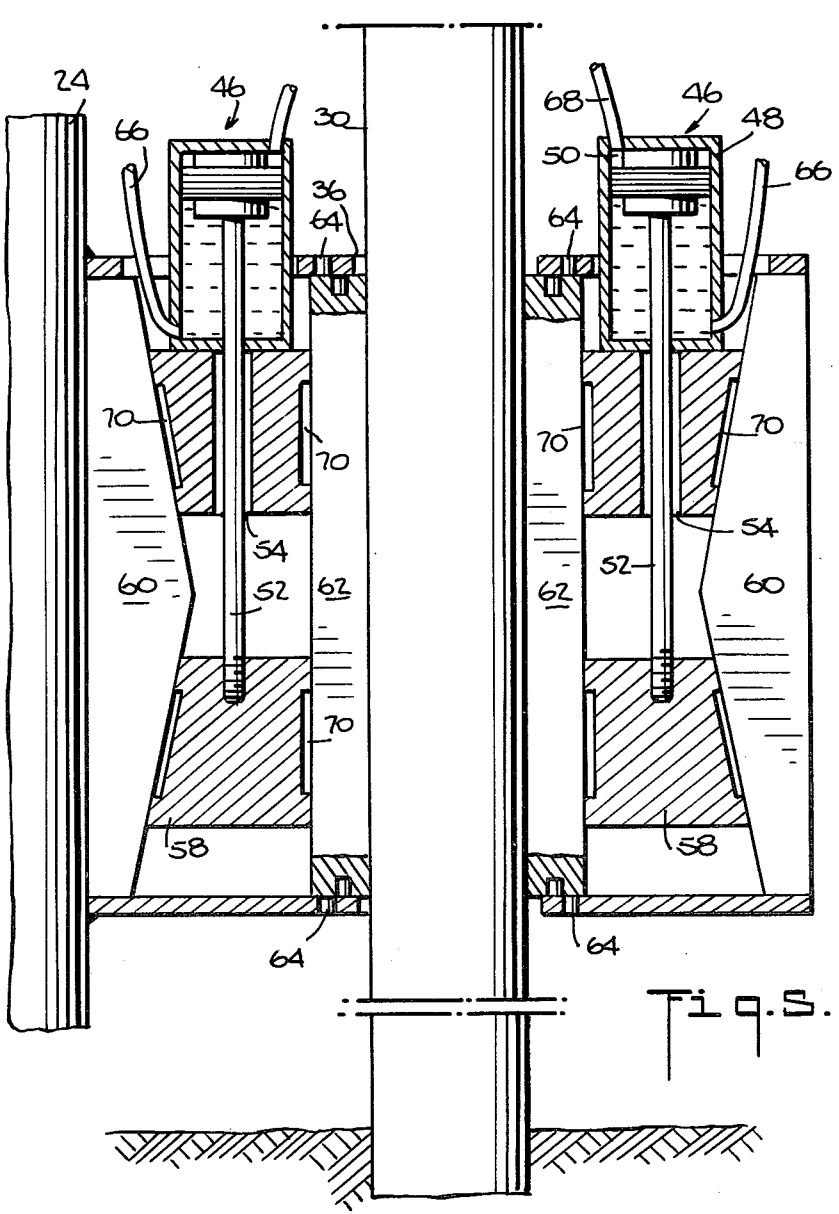
FIGS. 4 and 5 are vertical cross-sectional views of the same structure in the positions mentioned in the description of FIGS. 2 and 3, respectively.

From the description thus far, it will be appreciated that when fluid pressure is applied through the lines 66 to the underside of the ram cylinders 48, as viewed, the pistons 50 will rise while the cylinders descend through an appropriate opening in the upper retainer plate 32, and the region in the rams above the pistons exhausts through the lines 68. Such action raises the lower wedge element 58 while lowering the upper wedge element 56 along the respective convergent surfaces of the members 60 and forcing these wedge elements to move towards the pile. At the commencement of such movement, the wedge elements, bearing against the grippers 44, act to break the pins 64 to permit the grippers to move toward and grip the pile 30 as shown in FIG. 5, thus locking the pile to the collar, and therefore to the leg 24 with which it is integral. The inclination of the converging surfaces of the members 60 and the facing surfaces of the wedge elements is selected so that the friction forces developed therebetween under locking conditions render the same self-locking. It will be appreciated that by driving the pistons in the opposite direction, the wedge elements will return to the positions shown in FIG. 4 and the grippers will be unlocked from the pile.

Figure 7:
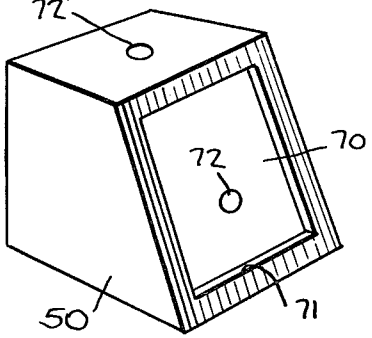
FIG. 7 is a perspective view of a recessed wedge element.
Figure 6:
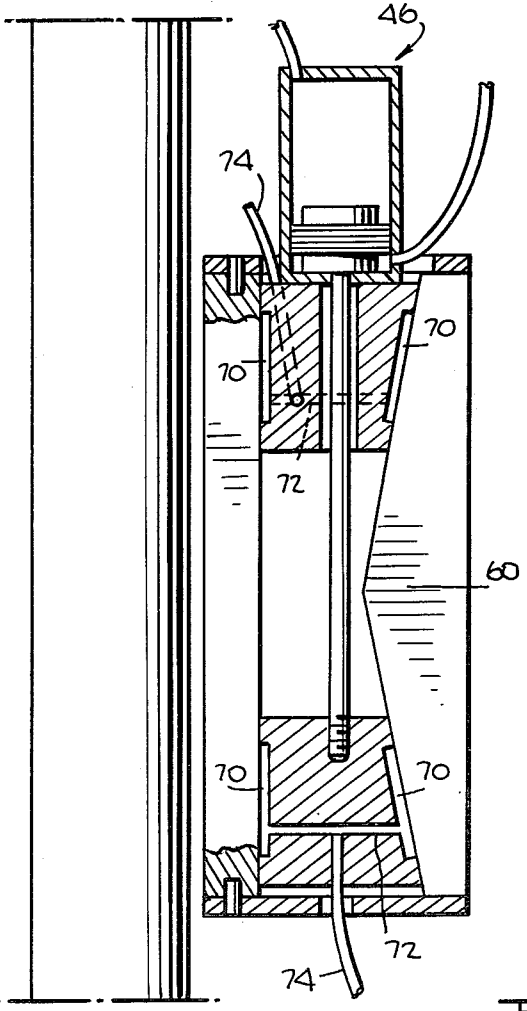
FIG. 6 is a view similar to the right hand portions of FIG. 4 illustrating means for establishing pressure in the recesses.

FIG. 6 illustrates in somewhat more detail portions of a typical locking assembly. In this connection, it will be recalled that a positive fluid pressure substantially in excess of ambient pressure is provided between a wedging element and a facing surface of one of the members to be locked while the wedging member is moved into wedging position. As actually shown, this positive fluid pressure is applied between each active surface of the wedge elements and the respective facing surfaces; and to achieve this end, I form recesses 70 in each such wedge surface, as shown in FIG. 7. These recesses are connected by suitable bores 72 to pressure line 74 for delivery to the recesses of the pressurized fluid, and are surrounded by a continuous land 71 which presents a gripping region 73 facing outwardly of the wedge element.

Figure 8:
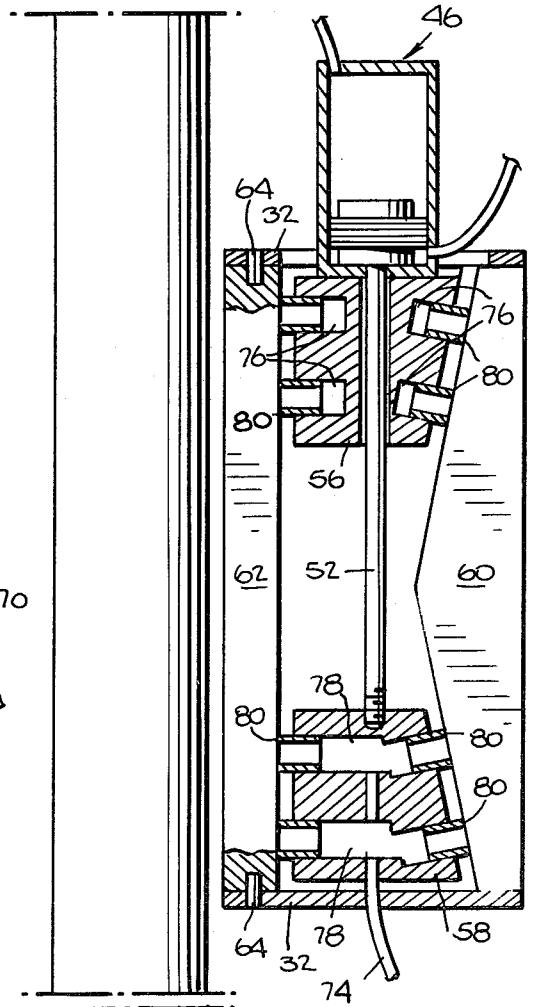
FIG. 8 is a view similar to the right hand portion of FIG. 4 illustrating recessed wedge means equipped with sleeves.
Figure 9:
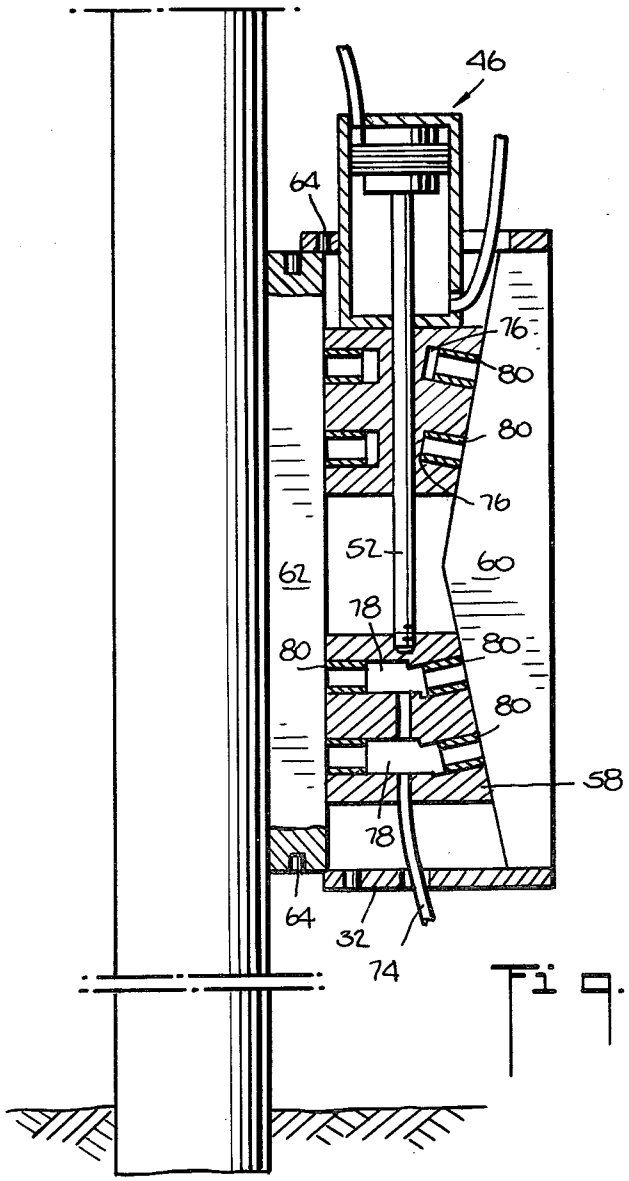
FIG. 9 is a view similar to FIG. 5 but illustrating recessed wedge means equipped with sleeves.

Turning now to FIGS. 8 and 9, there is illustrated a modified form of the invention in unlocked and locked positions, respectively. The pile 30, retainer plates 32, ram 46, connecting rod 52, cam member 60, gripper 62 and pins 64 are similar to those described in connection with the figures already referred to. However, in the present case, the wedge elements 56 and 58 are each formed with a plurality of relatively deep recesses 76 on each active face thereof, as shown in respect of wedge element 56, or with through bores 78, as shown in respect of wedge element 58, extending from one active wedge element face to the opposite active face. Each recess, or the opposite ends of each bore, as the case may be, is provided with a sleeve 80 which extends outwardly of its respective recess or bore across a clearance between its wedge element and the cam member 60 positioned to one side of the gripper 62 positioned on the other side, as shown.

Fluid under pressure is delivered to the recesses 76 and 78 through lines 74, only one of which is shown in FIGS. 8 and 9.

When the ram 46 is activated to draw the wedge elements together, and the recesses 76 or bores 78 are pressurized, the sleeves are pressed outwardly by the pressure acting on the annulus area of the sleeves. Thus, the sleeves contact the gripper and cam member and serve to reduce leakage of the pressurized fluid medium between the wedge elements and the corresponding facing surfaces. As mentioned, the pressurized fluid effects a slight deformation of the surfaces facing the wedge elements so that the wedge elements can move freely to locking position (FIG. 9) at which point the pressure is relieved allowing the deformed surfaces to spring back to their original positions to be locked by the wedge element gripping regions around the recesses or bores. Where grippers 62 are employed, the fluid under pressure will have been effective to rupture the pins 64 and move the grippers 62 to locking position against the pile 30.

Figure 10:
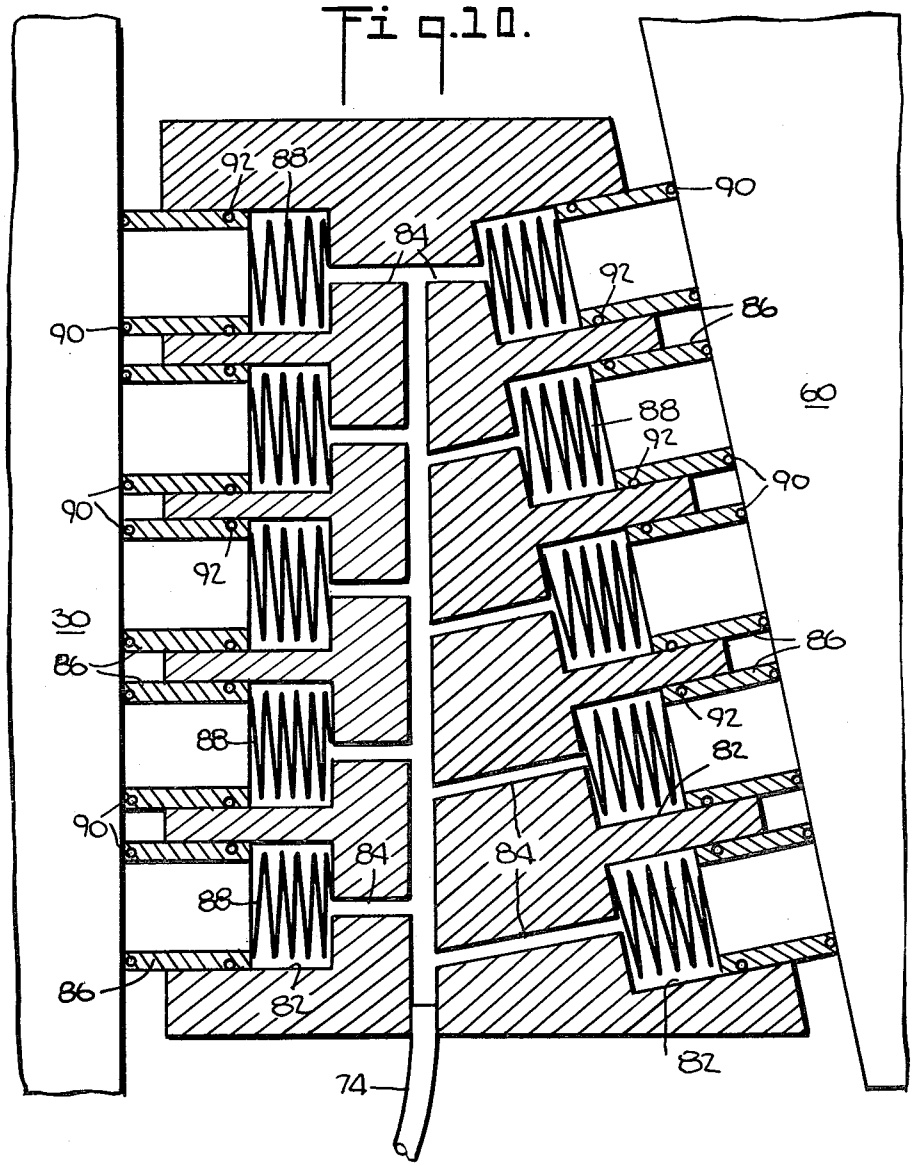
FIG. 10 is an enlarged cross-sectional view illustrating a wedge element having a plurality of recesses each equipped with seals and spring loaded sleeves.

FIG. 10 illustrates a wedge element having a plurality of recesses 82, each connected by a branch line 84 to fluid pressure line 74, and each provided with a sleeve 86 and a spring 88 bearing against the base of its recess and against the inner annulus area of its respective sleeve to urge the sleeves outwardly of the recesses.

These sleeves 86 are each equipped with annular foot seals 90 in their ends remote from their respective springs 88, and with annular side seals 92 around their outer side walls near their inner ends. It is believed that the operation of thus equipped wedge elements will readily be understood, in view of the discussions of previously described forms of the invention; but it should be appreciated that the springs push the sleeves and foot seals against the facing surfaces until enough fluid pressure is built up for the annulus area to maintain sealing contact. Moreover, the present modification not only acts substantially to reduce the friction between the wedge elements and the cam member on one side, and between the wedge elements and gripper or pile, as the case may be, on the other side, but also practically eliminates loss of the pressure fluid.

The seals may be lapped metal-to-metal, elastomeric, or piston ring type.

Figure 11:
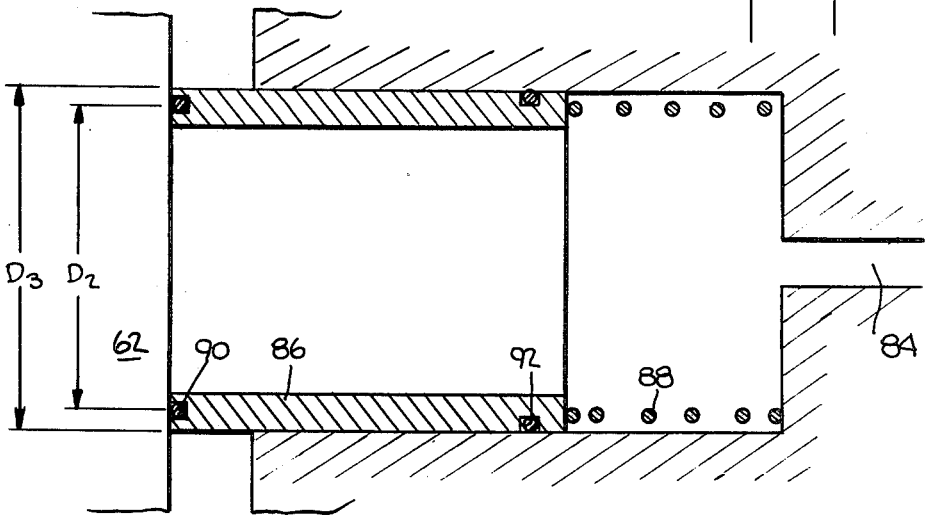
FIGS. 11 to 13 are detail views of various sleeve constructions, each shown in its working environment.
Figure 12:
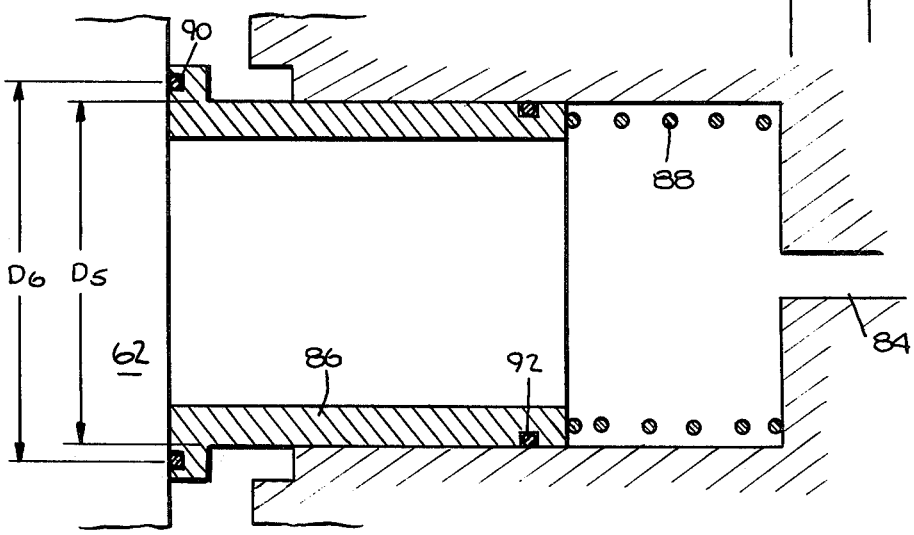
Figure 13:
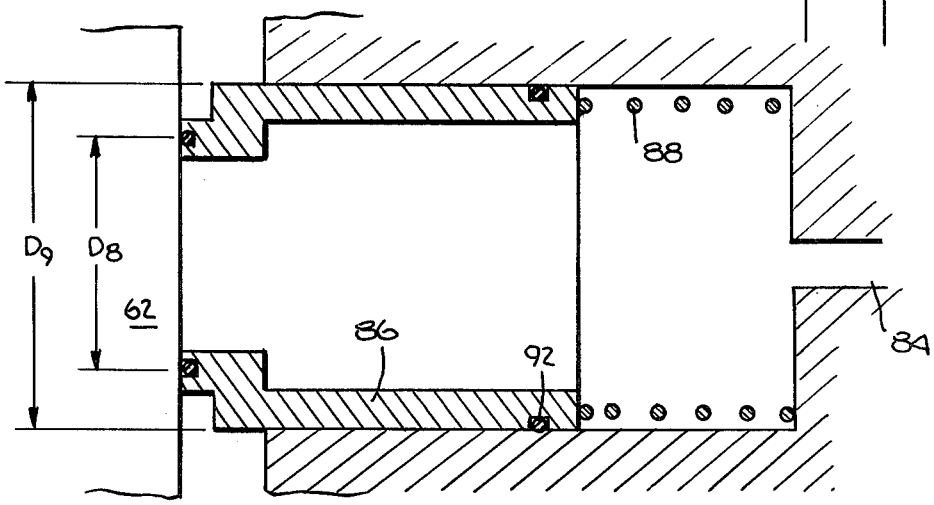

FIG. 11 is an enlarged view of a sleeve of the type shown in FIG. 10 and its immediate environment. Here the contact force between the sleeve and, say the gripper 62, is proportional to the difference between the area circumscribed by diameters $D_3$ and $D_2$. Should it be desired to reduce the contact force, the foot seal area could be enlarged, as shown in FIG. 12, so that the side seal area is less than that of the foot seal. In this case, the net annulus circumscribed by diameters $D_5$ and $D_6$ tends to push the sleeve away from the contact surface. On the other hand, if it is desired to increase the contact force, the configuration of FIG. 13 may be adopted wherein the annulus of $D_8$ and $D_9$ is larger than that circumscribed by $D_2$ and $D_3$ of FIG. 11.

Figure 14:
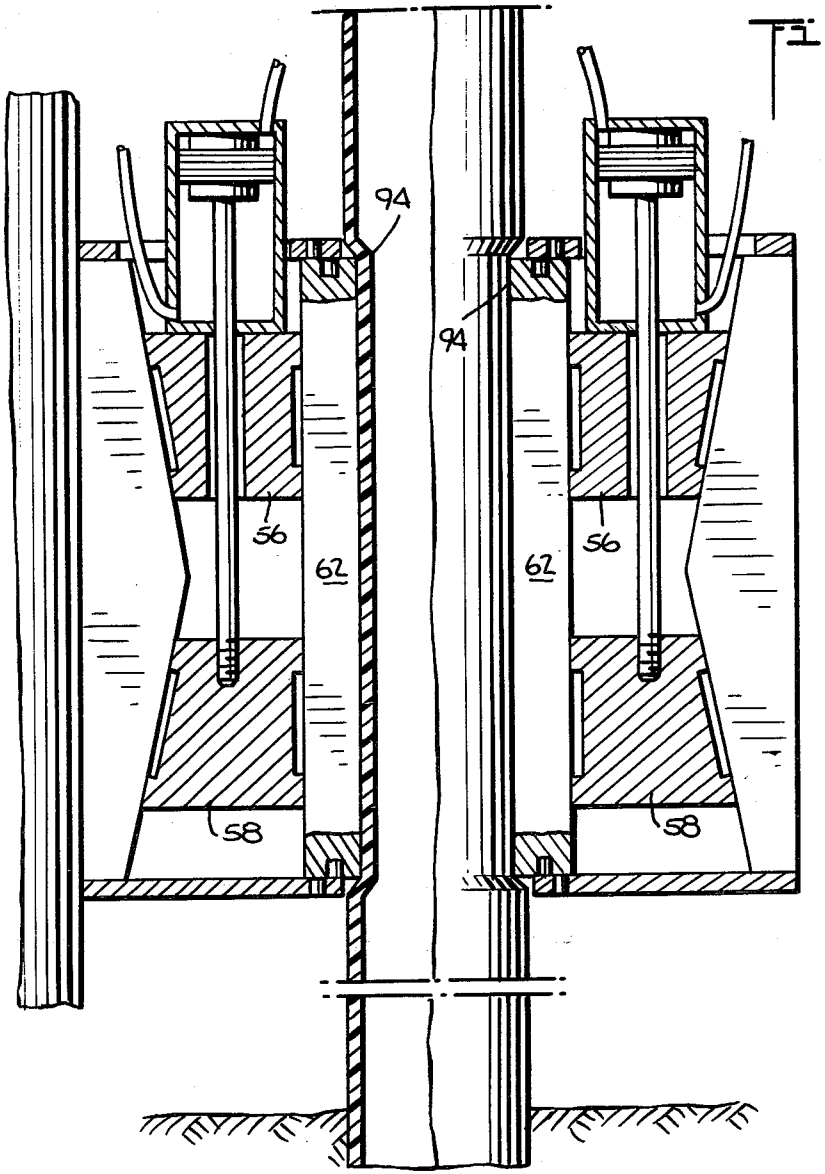
FIG. 14 illustrates the apparatus in locked position with gripping means in seats formed by same.

As has been stated, the force applied by the fluid under pressure may be of such magnitude as to cause the gripping means to deform the member, i.e. the pile, against which it is urged beyond its elastic limit in order to provide a seal thereon for itself. Referring to FIG. 14, there is shown an assembly in locked condition wherein the wedge elements 56 and 58 have urged the grippers 62 against the pile 30 with a force great enough to cause the grippers to indent the pile as at 94 to form seats in which the grippers are nested.

FIGS. 15, 16 and 17 illustrate a form of the invention wherein a pair of grippers comprising an active gripper 62 and a passive gripper **62*a* are disposed on opposite sides of the pile 30, but only one cylinder 46 and one pair of wedge elements 56, 58. The cam member 60 does not abut the leg 24 but is spaced from it and is connected by tension plates 96 to the passive gripper 62*a* (FIGS. 16 and 17). As shown in FIG. 16, these parts form a subassembly that is free to float between the retainer plates 32 which are reinforced by gussets 98**.

When the apparatus is actuated, the active gripper 62 moves to the left, as viewed in FIG. 15, until it contacts the pile 30. Further movement moves the cam member 60 to the right, as viewed, until the passive gripper **62*a*, drawn by the tension plates 96, contacts the pile 30. After both grippers have contacted the pile, continued actuation increases the gripping force to lock the parts together as shown in FIG. 17**.

Figure 18:
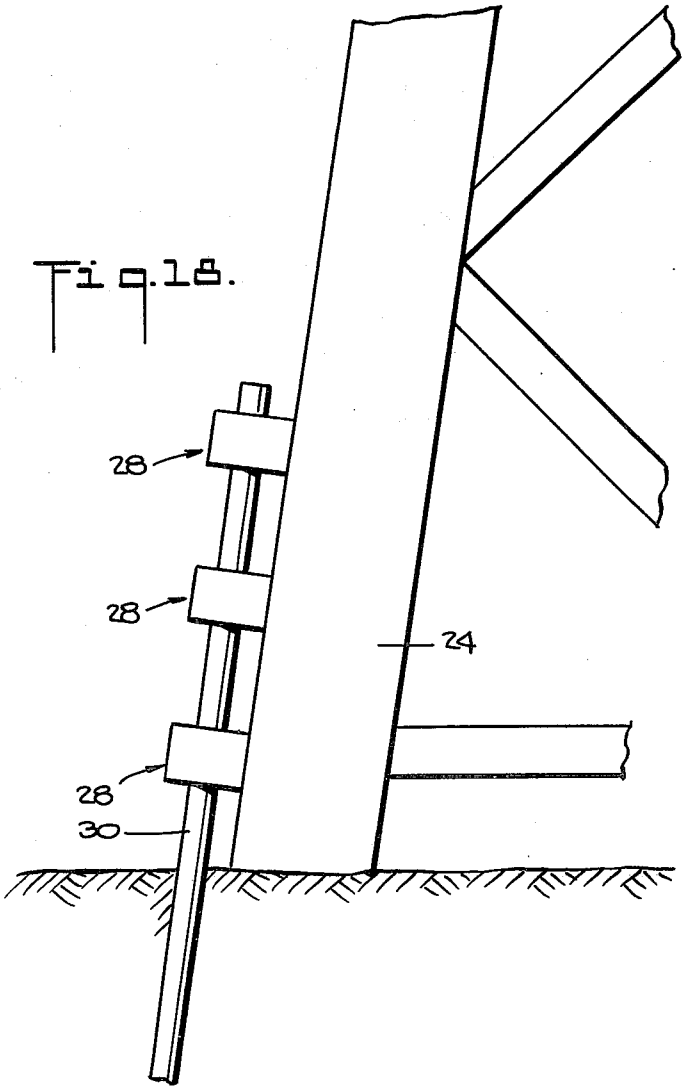
FIG. 18 is a partial elevational view illustrating the use of a plurality of locking apparatus for locking each pile to a leg of a platform.

As shown in FIG. 18, each pile 30 may be locked to a leg 24 by means of a plurality of collars 28 if necessary.

I believe that the construction and operation of my novel locking mechanism will now be understood and that the advantages thereof will be fully appreciated by those persons skilled in the art.

I claim:

1. Apparatus for locking two load supporting members together comprising: a surface on one of said members converging relative to an opposite surface on the other of said members, wedge means between said members and having a surface facing said converging surface, means adapted to move said wedge means along said converging surface in a converging direction relative to said opposite surface of the other of said members, gripping means positioned between said wedge means and said opposite surface on said other of said members and movable relative to said other of said members upon said movement of said wedge means to grip said other of said members, and pressure means including a source of fluid under pressure and means for transmitting said fluid under pressure from said source to a region between said surface of said wedge means and said converging surface for establishing a positive fluid pressure substantially in excess of ambient pressure between said surface of said wedge means and said converging surface while said wedge means move along said converging surface.

2. Apparatus according to claim 1, wherein said surface of said wedge means and said one of said surfaces are inclined relative to said surface of the other of said members at an angle selected so that the friction forces developed therebetween when said gripping means engage and grip said other of said members render the same in self-locking disposition.

3. Apparatus according to claim 1, wherein one of said facing surfaces is formed with a recess and said pressure means establishes said positive fluid pressure in said recess.

4. Apparatus according to claim 3, wherein said recess is formed in said surface of said wedge means.

5. Apparatus according to claim 1, wherein said one of said members is provided with a pair of surfaces each converging relative to said facing surface of the other of said members, said wedge means include a pair of wedges between said members and each having a surface facing one of said converging surfaces, respectively, said moving means is adapted to move said wedges along their respective converging surfaces in a converging direction relative to the other of said members, and said pressure means establish said positive pressure between said surfaces of said wedges and said respective converging surfaces while said wedges move along said respective converging surfaces.

6. Apparatus according to claim 5, wherein said surfaces of said wedge means and said pair of converging surfaces are inclined relative to said surface of the other of said members at an angle selected so that the friction forces developed therebetween when said gripping means engage and grip said other of said members render the same in self-locking disposition.

7. Apparatus according to claim 1, wherein the force adapted to move said wedge means in said converging direction is of sufficient magnitude to cause said gripping means to deform said other of said members to provide depressed seating means therein for said gripping means.

8. Apparatus for locking two load supporting members together comprising: a surface on one of said members converging relative to an opposite surface on the other of said members, wedge means between said members and having surfaces respectively facing said converging surface and said surface of the other of said members, means adapted to move said wedge means along converging surface in a converging direction relative to said opposite surface of the other of said members, means defining at least one recess in each of said wedge means surfaces and pressure means including a source of fluid under pressure and means for transmitting said fluid under pressure from said source to said at least one recess for establishing a positive fluid pressure substantially in excess of ambient pressure in said at least one recess while said wedge means move along said converging surface.

9. Apparatus according to claim 6, wherein said one of said members is provided with a pair of surfaces each converging relative to said facing surface of the other of said members, said wedge means include a pair of wedges between said members and each having a recessed surface facing one of said converging surfaces, respectively, said moving means is adapted to move said wedges along their respective converging surfaces in a converging direction relative to the other of said members, and said pressure means establish said positive pressure in said recesses while said wedges move along said respective converging surfaces.

10. Apparatus for locking two supporting members together comprising: a surface of one of said members converging relative to a facing surface of the other of said members, wedge means between said members and having a surface parallel to and facing said converging surface, means adapted to move said wedge means along said converging surface in a converging direction relative to said facing surface of the other of said members, gripping means between a region of said wedge means facing said surface on said other of said members and said surface of said other of said members, retainer means, means connecting said gripping means and said retainer means normally to maintain said gripping means adjacent to but spaced from said surface of said other of said members, said connecting means being adapted to rupture upon application of a predetermined force to said gripping means by said moving means moving said wedge means along said converging surface, whereby said gripping means are movable toward said surface of said other of said members to engage and grip a related region of said other of said members.

11. Apparatus according to claim 10, wherein said one of said members is provided with a pair of surfaces each converging relative to said facing surface of the other of said members, said wedge means include a pair of wedges between said members and each having a surface parallel to and facing one of said converging surfaces, respectively.

12. Apparatus according to claim 11, further including pressure means for establishing a positive fluid pressure substantially in excess of ambient pressure between said surface of said wedge means and said converging surface while said wedge means moves along said converging surface.

13. Apparatus according to claim 12, wherein said surfaces of said wedge means and said one of said surfaces are inclined relative to said surface of the other of said members at an angle selected so that the friction forces developed therebetween when said gripping means engage and grip said other of said members render the same in self-locking disposition.

14. Apparatus according to claim 11, wherein said wedge means include a pair of wedge elements and said means adapted to move said wedge means along said converging surfaces comprise fluid drive means including a cylinder connected to one of said wedge elements and a piston in said cylinder and connected to the other of said wedge elements whereby the application of fluid under pressure to one side of said piston moves said wedge elements along said converging surfaces, respectively, to shift said gripping means towards said other of said members to member locking position and the application of fluid under pressure to the other side of said piston moves said wedge elements in the opposite direction to member unlocking position.

15. Apparatus according to claim 10, further including a source of fluid under pressure and means for transmitting said fluid under pressure from said source to a region between said surface of said wedge means and said converging surface for establishing a positive fluid pressure substantially in excess of ambient pressure between said surface of said wedge means and said converging surface while said wedge means moves along said converging surface.

16. Apparatus according to claim 10, wherein said surfaces of said wedge means and said one of said surfaces are inclined relative to said surface of the other of said members at an angle selected so that the friction forces developed therebetween when said gripping means engage and grip said other of said members render the same in self-locking position.

17. Apparatus according to claim 10, wherein said wedge means include a pair of wedge elements and said means adapted to move said wedge means along said converging surfaces comprise fluid drive means including a cylinder connected to one of said wedge elements and a piston in said cylinder and connected to the other of said wedge elements whereby the application of fluid under pressure to one side of said piston moves said wedge elements along said converging surfaces, respectively, to shift said gripping means towards said other of said members to member locking position and the application of fluid under pressure to the other side of said piston moves said wedge elements in the opposite direction to member unlocking position.

18. Apparatus according to claim 10, wherein said predetermined force is of sufficient magnitude to cause said gripping means to deform said other of said members to provide depressed seating means therein for said gripping means.

19. Apparatus for locking two load supporting members together comprising: a surface on one of said members converging relative to a facing surface on the other of said members, wedge means between said members and having a first surface facing said converging surface, gripping means movable toward said other of said members upon movement of said wedge means to grip said other of said members, said wedge means having a second surface facing a surface of said other of said members, said wedge means surfaces each being formed with a recess, sleeve means telescopically disposed in each recess and having an end engaging the respective converging surface and said surface of said other of said members, and pressure means for establishing a positive fluid pressure substantially in excess of ambient pressure in said recesses when said wedge means move along said converging surface, said sleeve means being so arranged relative to said recesses and said converging surface and said surface of said other of said members as to retard the escape of said pressurized fluid between said wedge means and the respective surfaces facing said wedge means.

20. Apparatus according to claim 19, wherein spring means are provided in each recess to urge said sleeve means in a direction towards said respective surfaces facing said wedge means.

21. Apparatus according to claim 19, wherein seal means are provided between said sleeve means and surfaces of said wedge means defining said recesses and between the ends of said sleeve means and said respective surfaces facing said wedge means.

22. Apparatus according to claim 21, wherein said one of said members is provided with a pair of surfaces each converging relative to said facing surface of the other of said members, and said wedge means include a pair of wedges between said members and each having a first surface facing one of said conyerging surfaces, respectively, and a second surface facing a surface of said other of said members.

23. Apparatus for locking two load supporting members together comprising: a surface on one of said members converging relative to a facing surface on the other of said members, wedge means between said members and having a first surface facing said converging surface, means adapted to move said wedge means along said converging surface in a converging direction, gripping means movable toward said other of said members upon movement of said wedge means said wedge means having a second surface facing a surface of said gripping means, recesses being formed between a surface of said wedge means and said converging surface and between a surface of said wedge means and a surface of said gripping means, sleeve means telescopically disposed in each recess and having an end engaging the respective surface facing said recesses, and pressure means for establishing a positive fluid pressure substantially in excess of ambient pressure in said recesses when said wedge means move along said converging surface, said sleeve means being so arranged relative to said recesses and said converging surface and gripping surface as to retard the escape of said pressurized fluid between said wedge means and the respective surfaces facing said recesses.

* * * * *

UNITED STATES PATENT AND TRADEMARK OFFICE

CERTIFICATE OF CORRECTION

PATENT NO. : 4,161,807

DATED : July 24, 1979

INVENTOR(S) : WILLIAM J. SWENSON

It is certified that error appears in the above-identified patent and that said Letters Patent are hereby corrected as shown below:

Column 9, line 57, change "6" to --8--.

Signed and Sealed this

*Twenty-seventh* Day of *November 1979*

[SEAL]

*Attest:*

RUTH C. MASON
*Attesting Officer*

LUTRELLE F. PARKER
*Acting Commissioner of Patents and Trademarks*